US011926911B2

(12) United States Patent
Schroer et al.

(10) Patent No.: US 11,926,911 B2
(45) Date of Patent: Mar. 12, 2024

(54) MICROFLUIDIC PROCESS FOR THE GENERAL ELECTROCHEMICAL SYNTHESIS OF GEMINAL DIPSEUDOHALIDE OR HALIDE-PSEUDOHALIDE COMPOUNDS

(71) Applicant: Government of the United States, as represented by the Secretary of the Air Force, Wright-Patterson AFB, OH (US)

(72) Inventors: Thorsten G. Schroer, Palmdale, CA (US); Gregory E. LeCroy, Lancaster, CA (US); Miguel Aguila, Palmdale, CA (US); Mayra R. Rodriguez, Lancaster, CA (US); Tyler J. Downard, Phelan, CA (US); Brianna L. MacLeod, Lancaster, CA (US)

(73) Assignee: United States of America as represented by the Secretary of the Air Force, Wright-Patterson AFB, OH (US)

( * ) Notice: Subject to any disclaimer, the term of this patent is extended or adjusted under 35 U.S.C. 154(b) by 0 days.

(21) Appl. No.: 18/153,683

(22) Filed: Jan. 12, 2023

(65) Prior Publication Data

US 2023/0250540 A1 Aug. 10, 2023

Related U.S. Application Data

(60) Provisional application No. 63/267,635, filed on Feb. 7, 2022.

(51) Int. Cl.
*C25B 3/11* (2021.01)
*C25B 3/26* (2021.01)
(Continued)

(52) U.S. Cl.
CPC ..... *C25B 3/11* (2021.01); *C25B 9/19* (2021.01); *C25B 11/091* (2021.01)

(58) Field of Classification Search
CPC .... C25B 3/23; C25B 3/26; C25B 3/29; C25B 3/11; C25B 3/27
(Continued)

(56) References Cited

U.S. PATENT DOCUMENTS 2,469,396 A 5/1949 McCracken et al.
2,918,489 A 12/1959 Gold et al.
(Continued)

FOREIGN PATENT DOCUMENTS

CN 102732909 B 6/2012
WO 03004727 1/2003

OTHER PUBLICATIONS

Lister et al., ("Electrochemical Synthesis of 2,2-Dinitropropanol," ECS Transactions (Oct. 17, 2008), vol. 13, No. 11, pp. 27-38. (Year: 2008).*
(Continued)

*Primary Examiner* — Edna Wong
(74) *Attorney, Agent, or Firm* — AFMCLO/JAZ; James F. McBride

(57) ABSTRACT

A process for the microfluidic electrochemical synthesis of geminal dipseudohalide or halide-pseudohalide compounds comprising the steps of pumping a solution comprising a compound of Formula I

I (Continued)

Formula I

Formula II into a microfluidic electrochemical reactor in the presence of a base, one of a halide or pseudohalide salt (MY), and a mediator;

applying an electrical current through the microfluidic electrochemical reactor; and performing oxidative addition to create a geminal dipseudohalide or halide-pseudohalide compound of the general Formula II

II

14 Claims, 6 Drawing Sheets

(51) Int. Cl.
*C25B 3/27* (2021.01)
*C25B 9/19* (2021.01)
*C25B 11/091* (2021.01)

(58) Field of Classification Search
USPC ..... 205/415, 422, 432, 436, 437, 441, 444, 205/459, 461, 460, 431, 435, 445
See application file for complete search history.

(56) References Cited

U.S. PATENT DOCUMENTS

| | | | |
|---|---|---|---|
| 2,997,504 | A | 8/1961 | Shechter et al. |
| 4,654,128 | A | 3/1987 | Leroux et al. |
| 4,774,366 | A | 9/1988 | Grakauskas et al. |
| RE33,836 | E | 3/1992 | Resor, III et al. |
| 6,790,076 | B1 | 2/2004 | Fossum et al. |
| 7,713,401 | B2 | 5/2010 | Lister et al. |
| 7,909,971 | B2 | 3/2011 | Nuzzo et al. |
| 9,192,933 | B2 | 11/2015 | Whitesides et al. |
| 9,423,301 | B2 | 8/2016 | Savoy et al. |
| 9,507,064 | B2 | 11/2016 | Brongersma et al. |
| 9,762,813 | B2 | 9/2017 | Marks et al. |
| 9,939,129 | B2 | 4/2018 | Byrnes et al. |
| 2002/0183050 | A1 | 12/2002 | Kuon et al. |
| 2009/0038953 | A1 * | 2/2009 | Lister ..... C25B 3/00 568/944 |

OTHER PUBLICATIONS

Roth et al., "Continuous-Flow Microfluidic Electrochemical Synthesis: Investigating a New Tool for Oxidative Chemistry," Journal of Flow Chemistry (Jun. 19, 2013), vol. 3, No. 2, pp. 34-40. (Year: 2013).*

Ilovaisky et al., "Electrooxidative Coupling of Salts of Nitro Compounds with Halide, Nitrite, Cyanide, and Phenylsulfinate Anions," Russian Chemical Bulletin (Jul. 2005), vol. 54, pp. 1585-1592. (Year: 2005).*

Wright et al., "Electrolytic Preparation of Gem-Dinitroparaffins," Tetrahedron (Jun. 1, 1963), vol. 19, Suppl. 1, pp. 3-15. (Year: 1963).*

Mo et al., "A Multifunctional Microfluidic Platform for High-Throughput Experimentation of Electroorganic Chemistry," Angewandte Chemie (Nov. 16, 2020), vol. 132, No. 47, pp. 21076-21080. (Year: 2020).*

Matacz, Z., et al., Oxidative Substitution in Salts of Nitroalkanes, Polish Journal of Chemistry (Formerly Roczniki Chemii), 53, 187 (1979).

Eremenko, L.T., et al., Peculiarities of the Nitration of Secondary Polynitroalkanes, UDC 541.124:542.958.1:547.414.3.

Tselinskii, I.V., et al., Oxidative coupling of the azide ion with anions of primary nitroalkanes. Synthesis of 1-azido-1-nitroalkanes, Russian Chemical Bulletin, International Edition, vol. 51, No. 8, pp. 1466-1467, Aug. 2002.

Ilovaisky, A.I., et al., Electrooxidative coupling of salts of nitro compounds with halide, nitrite, cyanide, and phenylsulfinate anions, Russian Chemical Bulletin, International Edition, vol. 54, No. 7, pp. 1585-1592, Jul. 2005.

Paraskos, A., et al., Pilot Scale Electrochemical Synthesis of Potassium 2,2-Dinitroethane (KDNE), SERDP Project WP-1460.

Electrochemical Oxidation of Alkylnitro Compounds, PP-1345, Strategic Environmental Research and Development Programs Office.

Wright, C.M., et al., Electrolytic Preparation of Gem~Dinitroparaffins, Tetrahedron, 1963, vol. 19 Suppl. 1, pp. 3 to 15. Pergamon Press Ltd.

Pauler, D.K., et al., A mechanism for the decomposition of dinitropropyl compounds, Phys. Chem. Chem. Phys., 2007, 9, 5121-5126.

Petrova, N.A., et al., Oxidative Nitration of Mononitroalkanes in a System Sodium Nitrite-Polyhaloalkane, ISSN 1070-4280, Russian Journal of Organic Chemistry, 2007, vol. 43, No. 5, pp. 646-651.

Watts, K., et al., Electrochemical Synthesis in Microreactors, J. Flow Chem. 2014, 4(1), 2-11.

Bedford, C.D., et al., New Synthetic Routes to gem-Dinitroalkanes and Derivatives, J. Org. Chem., vol. 43, No. 12, 1978.

Ogibin, Y.N., et al., Electrolysis of Nitro Compound Salts: Application in Ketone Synthesis, Russian Journal of Electrochemistry, vol. 39, No. 11, 2003, pp. 1220-1227.

Kaplan, R.B., et al., A New General Reaction for Preparing gem Dinitro Compounds: Oxidative Nitration, Communications to the editor, p. 3535, Aug. 20, 1961.

Elsherbini, M., et al., Electroorganic Synthesis under Flow Conditions, DOI: 10.1021/acs.accounts.9b00497.

Hamel, E.E., et al., Synthesis of 2,2-Dinitropropanol, I & EC Product Research and Development, vol. 1, No. 2, Jun. 1962.

Bahner, C.T., Electrolytic Production of gem-Dinitroparaffins, Industrial and Engineering Chemistry vol. 44, No. 2.

Lister, T.E., et al., Electrochemical synthesis of 2,2-dinitropropanol, J Appl Electrochem (2008) 38:523-529 DOI 10.1007/s10800-007-9467-1.

Noel, T., et al., The Fundamentals Behind the Use of Flow Reactors in Electrochemistry, DOI: 10.1021/acs.accounts.9b00412.

* cited by examiner

MICROFLUIDIC PROCESS FOR THE GENERAL ELECTROCHEMICAL SYNTHESIS OF GEMINAL DIPSEUDOHALIDE OR HALIDE-PSEUDOHALIDE COMPOUNDS

Pursuant to 37 C.F.R. § 1.78(a)(4), this application claims the benefit of and priority to prior filed Provisional Application Ser. No. 63/267,635, filed 7 Feb. 2022, which is expressly incorporated herein by reference.

RIGHTS OF THE GOVERNMENT

The invention described herein may be manufactured and used by or for the Government of the United States for all governmental purposes without the payment of any royalty.

FIELD OF THE INVENTION

The present invention relates to microfluidic processes and methods for the electrochemical synthesis of energetic materials and intermediates thereof. More specifically, this invention relates to the oxidative addition of halogen or pseudohalogen functional groups to methyl, primary, and secondary pseudohalide compounds, utilizing electrolysis within a microfluidic reactor. Specifically, the invention herein relates to a microfluidic synthesis for the electrochemically driven oxidative addition of halide or pseudohalide anions to organic pseudohalide compounds through electron transfer between an electrode and said organic compound or electron transfer between an electrode, a mediator, and said organic compound. This process results in a geminal dipseudohalide or mixed geminal halide-pseudohalide compounds of the general formula, $R_1R_2CXY$ ($R_1$, $R_2$=H, methyl (—$CH_3$), ethyl (—$CH_2CH_3$), propyl (—$CH_2CH_2CH_3$), hydroxy (—OH), methoxy (—$CH_2OH$), ethoxy (—$CH_2CH_2OH$), methyl ester (—$CH_2COOCH_3$), propyl methyl ester (—$CH_2CH_2COOCH_3$), cyclopropyl, cyclobutyl, cyclopentyl, cyclohexyl, azetidine, oxetane, 2,2-dimethyl-1,3,dioxane, phenyl, or other organic functional group and X=nitro (—$NO_2$), azido (—$N_3$), cyano (—CN), cyanato (—OCN), -thiocyanato (SCN), isothiocyanato (—NCS) etc. and Y=chloro (—Cl), bromo (—Br), iodo (—I), nitro (—$NO_2$), azido (—$N_3$), cyano (—CN), cyanato (—OCN), thiocyanato (—SCN), etc. as depicted in FIG. 1)

BACKGROUND OF THE INVENTION

Geminal halide-pseudohalide and dipseudohalide compounds are important ingredients and building blocks within the energetic and pharmaceutical industries. For example, gem-halide-nitro compounds have long been of interest to the pharmaceutical industry owing to their presence within molecules displaying biocidal and antimicrobial activity. Additionally, gem-halide-nitro compounds may also serve as precursors for some gem-dinitro compounds. For example, 2,2-dinitroethane, an important ingredient in the synthesis of energetics, can be synthesized through the substitution of the chlorine of a gem-chloronitro compound with a nitrite anion.

Oxidative coupling of primary and secondary acidic nitro compounds with organic or inorganic anions has been the main approach in the introduction of functional groups to the α-position of nitroparaffins. These methods generally utilize chemical oxidizers such as elemental chlorine and bromine, silver nitrate, potassium ferricyanide, sodium persulfate, as well as others. For example, for the synthesis of the gem-dinitro compound 1,1-dinitroethane, catalytic quantities of $K_4Fe(CN)_6$ and stoichiometric quantities of $Na_2S_2O_8$ were utilized for the oxidation of nitroethane in the presence of $NaNO_2$. While this method generally gave reasonable yields of ~60%, the poor aqueous solubility of the chemical oxidizers results in a large waste stream, accounting for more than 98 wt % of the whole production stream. In order to minimize the waste stream, an electrochemical method was devised for the electrochemical oxidative nitration of nitroethane to synthesize 1,1-dinitroethane. While the waste stream of this process was less than that of the chemical oxidation, $K_4Fe(CN)_6$ was still necessary to serve as an electron shuttle between the electrode and nitronate anion. The scaling of both of these processes to an industrial production level creates high capital costs for the investments in infrastructure and equipment. Therefore, it is of interest to the pharmaceutical and energetics industry to develop a process for the production of gem-pseudohalide and gem-halide-pseudohalide compounds, which has a low waste stream while remaining flexible and requiring minimal capital investment.

What is desired are processes and methods for the general synthesis of geminal dipseudohalide and halide-pseudohalide compounds.

SUMMARY OF THE INVENTION

The present invention overcomes the foregoing problems and other shortcomings, drawbacks, and challenges in manufacturing energetic compounds. While the invention will be described in connection with certain embodiments, it will be understood that the invention is not limited to these embodiments. To the contrary, this invention includes all alternatives, modifications, and equivalents as may be included within the spirit and scope of the present invention.

The present invention provides processes and methods for the electrochemical synthesis of geminal dipseudohalide and halide-pseudohalide compounds conducted within a microfluidic environment (e.g., microfluidic electrochemical cell of FIG. 2). A microfluidic environment is defined herein as a reaction in which the solutions are geometrically constrained to sub-millimeter scale during key chemical transformations. In this specific embodiment, the necessary oxidation reaction is occurring at the anode surface through the supply of a controlled current or controlled voltage within a microfluidic electrochemical reactor. The electrode transfer may proceed directly to the organic pseudohalide or geminal dipseudohalide or halide-pseudohalide compound or through a chemical mediator, which shuttles electrons between the compounds and the electrode. Particular embodiments of the invention presented herein may be conducted in an undivided (single compartment, FIG. 2) or divided (dual compartment, FIG. 3) electrochemical reactor. An undivided cell defined herein as a microfluidic electrochemical cell in which the anode and cathode are in contact with the same electrolyte solution. A divided cell is defined herein as a microfluidic electrochemical cell in which a semipermeable membrane separates two electrolyte solutions into an anode compartment and a cathode compartment.

According to one embodiment of the present invention, a process for the microfluidic electrochemical synthesis of geminal dipseudohalide or halide-pseudohalide compounds comprises the steps of pumping a solution comprising a compound of Formula I

I

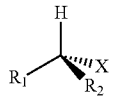

into a microfluidic electrochemical reactor in the presence of a base, one of a halide or pseudohalide salt (MY), and a mediator; applying an electrical current through the microfluidic electrochemical reactor; and performing oxidative addition to create a geminal dipseudohalide or halide-pseudohalide compound of the general Formula II

II

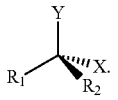

According to a first variation of the invention, the reagent of Formula I has the structure of $R_1R_2CHX$ and $R_1$ and $R_2$ are any combination of H, methyl (—$CH_3$), ethyl (—$CH_2CH_3$), propyl (—$CH_2CH_2CH_3$), hydroxy (—OH), methoxy (—$CH_2OH$), ethoxy (—$CH_2CH_2OH$), methyl ester (—$CH_2COOCH_3$), propyl methyl ester (—$CH_2CH_2COOCH_3$), cyclopropyl, cyclobutyl, cyclopentyl, cyclohexyl, azetidine, oxetane, 2,2-dimethyl-1,3,dioxane, and phenyl, and X is a pseudohalide moiety selected from the group consisting of nitro (—$NO_2$), cyano (—CN), cyanate (—CNO), thiocyanoate (—SCN), and thioisocyanato (—NCS).

According to another variation of the invention, the base comprises at least one hydroxide, carbonate, or phosphate of a member of the group consisting of [Li]+, [Na]+, [K]+, [Cs]+, [Rb]+, and [$NH_4$]+.

According to a further variation of the invention, the base comprises at least one lithium hydroxide (LiOH), sodium hydroxide (NaOH), potassium hydroxide (KOH), cesium hydroxide (CsOH), rubidium hydroxide (RbOH), ammonium hydroxide ($NH_4OH$), lithium carbonate ($Li_2CO_3$), sodium carbonate ($Na_2CO_3$), potassium carbonate ($K_2CO_3$), cesium carbonate ($Cs_2CO_3$), rubidium carbonate ($Rb_2CO_3$), lithium phosphate ($Li_2PO_4$), sodium phosphate ($Na_3PO_4$), sodium phosphate dibasic ($Na_2HPO_4$), potassium phosphate ($K_3PO_4$), potassium phosphate dibasic ($K_2HPO_4$), or ammonium phosphate dibasic ($(NH_4)_2PO_4$).

According to another variation of the invention, the pseudohalide salt (MY) is selected from the group consisting of [Li]+, [Na]+, [K]+, [Cs]+, [Rb]+, or [$NH_4$]+ salts of nitrite ($NO_2^-$), azide ($N_3^-$), cyanide ($CN^-$), cyanate ($OCN^-$), thiocyanate ($SCN^-$), and isothiocyanate (NCS—).

According to a further variation of the invention, the pseudohalide salt (MY) is selected from the group consisting of sodium nitrite ($NaNO_2$), potassium nitrite ($KNO_2$), sodium cyanide (NaCN), potassium cyanide (KCN), sodium cyanate (NaCNO), potassium cyanate (KCNO), sodium thiocyanate (NaSCN), potassium thiocyanate (KSCN), sodium thioisocyanate (NaNCS), potassium thioisocyanate (KNCS), sodium azide ($NaN_3$), and potassium azide ($KN_3$).

According to another variation of the invention, the halide salt (MY) source is selected from the group consisting of [Li]+, [Na]+, [K]+, [Cs]+, [Rb]+ and [$NH_4$]+ salts of chloride ($Cl^-$) and bromide ($Br^-$).

According to a further variation of the invention, the halide salt (MY) source is selected from the group consisting of lithium chloride (LiCl), potassium chloride (KCl), sodium chloride (NaCl), cesium chloride (CsCl), rubidium chloride (RbCl), ammonium chloride ($NH_4Cl$), lithium bromide (LiBr), potassium bromide (KBr), sodium bromide (NaBr), cesium bromide (CsBr), rubidium bromide (RbBr), and ammonium bromide ($NH_4Br$).

According to another variation of the invention, the mediator is selected from the group consisting of potassium ferricyanide $K_3Fe(CN)_6$, potassium ferrocyanide ($K_4Fe(CN)_6$), benzoquinone, 2,2-Azino-bis(2-ethylbenzothiazoline-6-sulfonic acid), 1,1-Dimethyl-ferrocene, ferrocene monocarboxylic acid, sodium ferricyanide, 2,6-dichlorophenol-indophenol, hexaammineruthenium (III) chloride, 1,4-Napthoquinone, and $Os(im(dm\text{-}bpy)_2Cl$.

According to a further variation of the invention, the process further comprises performing the oxidative addition in a single pass of the solution, base, halide or pseudohalide salt (MY), and mediator through the microfluidic electrochemical reactor.

According to another variation of the invention, the process further comprises controlling the oxidative addition of a halide or pseudohalide to the pseudohalide compound of Formula I through one of potentiostatic (controlled potential) or galvanostatic (controlled current) operating conditions.

According to a further variation of the invention, the microfluidic electrochemical reactor comprises electrodes comprising one or more elements selected from the group consisting of iron, nickel, platinum, copper, cobalt, titanium, lead dioxide, mixed metal oxides, gold, palladium, rhodium, iridium, ruthenium, silver, graphite, carbon black, glassy carbon, carbonaceous materials.

According to another variation of the invention, the microfluidic electrochemical reactor is an undivided (single compartment) microfluidic electrochemical cell.

According to a further variation of the invention, the microfluidic electrochemical reactor is a divided (dual compartment) microfluidic electrochemical cell, further comprising a semi-permeable membrane separating an anode compartment and a cathode compartment of the microfluidic electrochemical cell.

According to another variation of the invention, the semi-permeable membrane is a proton exchange membrane (PEM) or an anion exchange membrane (AEM).

According to another variation of the invention, an electrolytic oxidation reaction is conducted in the anode compartment in a two-phase plug-flow, the two-phase plug flow comprising the anode solution and the organic solvent, to continually extract the compound of Formula II.

According to a further variation of the invention, the organic solvent is one or more of chloroform, dichloromethane, 1,2-dichloroethane, carbon tetrachloride, cyclohexane, diethyl ether, dioxane, ethyl acetate, heptane, hexane, methyl ethyl ketone, methyl tert-butyl ether, pentane, toluene, and xylene.

In a second embodiment of the invention, a process for the microfluidic electrochemical synthesis of geminal dipseudohalide or halide-pseudohalide compounds comprises the steps of pumping a solution comprising a compound of Formula I

I

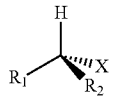

into a microfluidic electrochemical reactor in the presence of a base, one of a halide or pseudohalide salt (MY), and a mediator; applying an electrical current through the microfluidic electrochemical reactor; and performing oxidative addition to create a geminal dipseudohalide or halide-pseudohalide compound of the general Formula II,

II

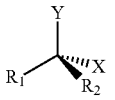

wherein the reagent of Formula I has the structure of $R_1R_2CHX$ and $R_1$ and $R_2$ are any combination of H, methyl (—$CH_3$), ethyl (—$CH_2CH_3$), propyl (—$CH_2CH_2CH_3$), hydroxy (—OH), methoxy (—$CH_2OH$), ethoxy (—$CH_2CH_2OH$), methyl ester (—$CH_2COOCH_3$), propyl methyl ester (—$CH_2CH_2COOCH_3$), cyclopropyl, cyclobutyl, cyclopentyl, cyclohexyl, azetidine, oxetane, 2,2-dimethyl-1,3,dioxane, and phenyl, and X is a pseudohalide moiety selected from the group consisting of nitro (—$NO_2$), cyano (—CN), cyanate (—CNO), thiocyanoate (—SCN), and thioisocyanato (—NCS), wherein the base comprises at least one hydroxide, carbonate, or phosphate of a member of the group consisting of [Li]+, [Na]+, [K]+, [Cs]+, [Rb]+, and $[NH_4]$+, or at least one lithium hydroxide (LiOH), sodium hydroxide (NaOH), potassium hydroxide (KOH), cesium hydroxide (CsOH), rubidium hydroxide (RbOH), ammonium hydroxide ($NH_4OH$), lithium carbonate ($Li_2CO_3$), sodium carbonate ($Na_2CO_3$), potassium carbonate ($K_2CO_3$), cesium carbonate ($Cs_2CO_3$), rubidium carbonate ($Rb_2CO_3$), lithium phosphate ($Li_2PO_4$), sodium phosphate ($Na_3PO_4$), sodium phosphate dibasic ($Na_2HPO_4$), potassium phosphate ($K_3PO_4$), potassium phosphate dibasic ($K_2HPO_4$), or ammonium phosphate dibasic ($(NH_4)_2PO_4$), wherein the pseudohalide salt (MY) is selected from the group consisting of [Li]+, [Na]+, [K]+, [Cs]+, [Rb]+ or $[NH_4]$+ salts of nitrite ($NO_2^-$), azide ($N_3^-$), cyanide (CN−), cyanate ($OCN^-$), thiocyanate ($SCN^-$), and isothiocyanate ($NCS^-$), or is selected from the group consisting of sodium nitrite ($NaNO_2$), potassium nitrite ($KNO_2$), sodium cyanide (NaCN), potassium cyanide (KCN), sodium cyanate (NaCNO), potassium cyanate (KCNO), sodium thiocyanate (NaSCN), potassium thiocyanate (KSCN), sodium thioisocyanate (NaNCS), potassium thioisocyanate (KNCS), sodium azide ($NaN_3$), and potassium azide ($KN_3$), wherein the halide salt (MY) source is selected from the group consisting of [Li]+, [Na]+, [K]+, [Cs]+, [Rb]+ or $[NH_4]$+ salts of chloride ($Cl^-$) and bromide ($Br^-$), or is selected from the group consisting of lithium chloride (LiCl), potassium chloride (KCl), sodium chloride (NaCl), cesium chloride (CsCl), rubidium chloride (RbCl), ammonium chloride ($NH_4Cl$), lithium bromide (LiBr), potassium bromide (KBr), sodium bromide (NaBr), cesium bromide (CsBr), rubidium bromide (RbBr), and ammonium bromide ($NH_4Br$), and wherein the mediator is selected from the group consisting of potassium ferricyanide $K_3Fe(CN)_6$, potassium ferrocyanide ($K_4Fe(CN)_6$), benzoquinone, 2,2-Azino-bis(2-ethylbenzothiazoline-6-sulfonic acid), 1,1-Dimethyl-ferrocene, ferrocene monocarboxylic acid, sodium ferricyanide, 2,6-dichlorophenol-indophenol, hexaammineruthenium (III) chloride, 1,4-Napthoquinone, and $Os(im(dm\text{-}bpy)_2Cl$.

Additional objects, advantages, and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and constitute a part of this specification, illustrate embodiments of the present invention and, together with a general description of the invention given above, and the detailed description of the embodiments given below, serve to explain the principles of the present invention.

In this document, relational terms such as first and second, top and bottom, and the like may be used solely to distinguish one entity or action from another entity or action without necessarily requiring or implying any actual such relationship or order between such entities or actions. The terms "comprises," "comprising," "includes," "including," "has," "having," or any other variations thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises . . . a" does not, without more constraints, preclude the existence of additional identical elements in the process, method, article, or apparatus that comprises the element.

Figure 1:
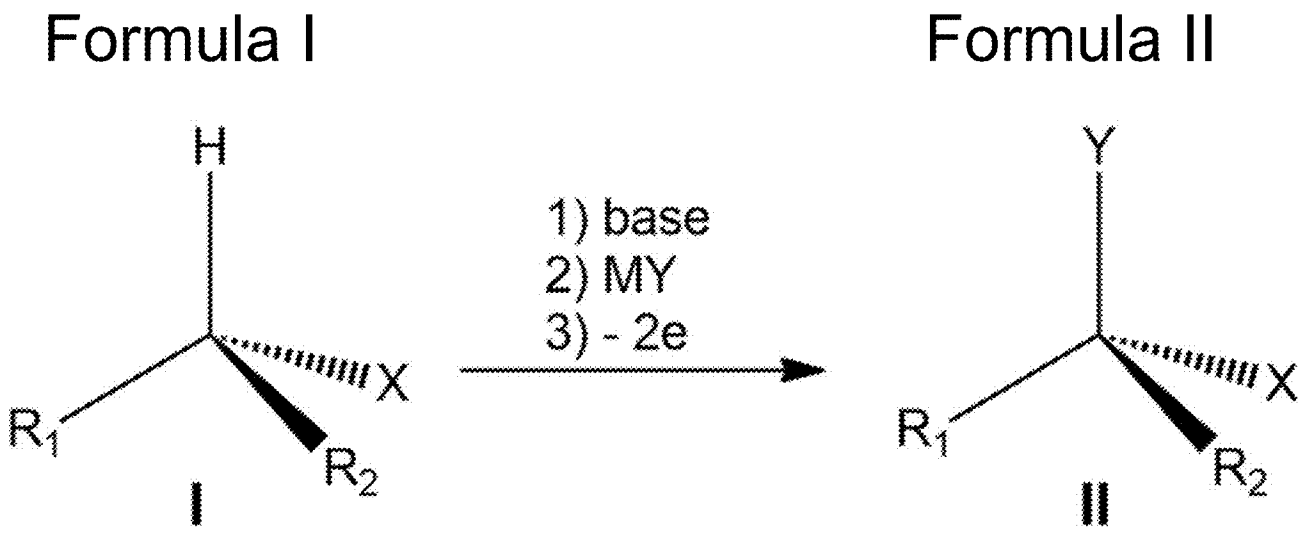

Reference throughout this document to "one embodiment," "certain embodiments," "an embodiment," "implementation(s)," "aspect(s)," or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means "any of the following: A; B; C; A and B; A and C; B and C; A, B and C." An exception to this definition will occur only when a combination of elements, functions, steps or acts are in some way inherently mutually exclusive. Also, grammatical conjunctions are intended to express any and all disjunctive and conjunctive combinations of conjoined clauses, sentences, words, and the like, unless otherwise stated or clear from the context. Thus, the term "or" should generally be understood to mean "and/or" and so forth.

All documents mentioned herein are hereby incorporated by reference in their entirety. References to items in the singular should be understood to include items in the plural, and vice versa, unless explicitly stated otherwise or clear from the text.

Recitation of ranges of values herein are not intended to be limiting, referring instead individually to any and all values falling within the range, unless otherwise indicated, and each separate value within such a range is incorporated into the specification as if it were individually recited herein. The words "about," "approximately," or the like, when accompanying a numerical value, are to be construed as indicating a deviation as would be appreciated by one of ordinary skill in the art to operate satisfactorily for an intended purpose, such as +/−5-10%. Ranges of values and/or numeric values are provided herein as examples only, and do not constitute a limitation on the scope of the described embodiments. The use of any and all examples, or exemplary language ("e.g.," "such as," or the like) provided herein, is intended merely to better illuminate the embodiments and does not pose a limitation on the scope of the embodiments. No language in the specification should be construed as indicating any unclaimed element as essential to the practice of the embodiments.

For simplicity and clarity of illustration, reference numerals may be repeated among the figures to indicate corresponding or analogous elements. Numerous details are set forth to provide an understanding of the embodiments described herein. The embodiments may be practiced without these details. In other instances, well-known methods, procedures, and components have not been described in detail to avoid obscuring the embodiments described. The description is not to be considered as limited to the scope of the embodiments described herein.

In the following description, it is understood that terms such as "first," "second," "top," "bottom," "up," "down," "above," "below," and the like, are words of convenience and are not to be construed as limiting terms. Also, the terms apparatus and device may be used interchangeably in this text.

FIG. 1 presents a schematic representation of the chemical transformation of a pseudohalide compound into a geminal dipseudohalide or halide-pseudohalide compound.

Figure 2:
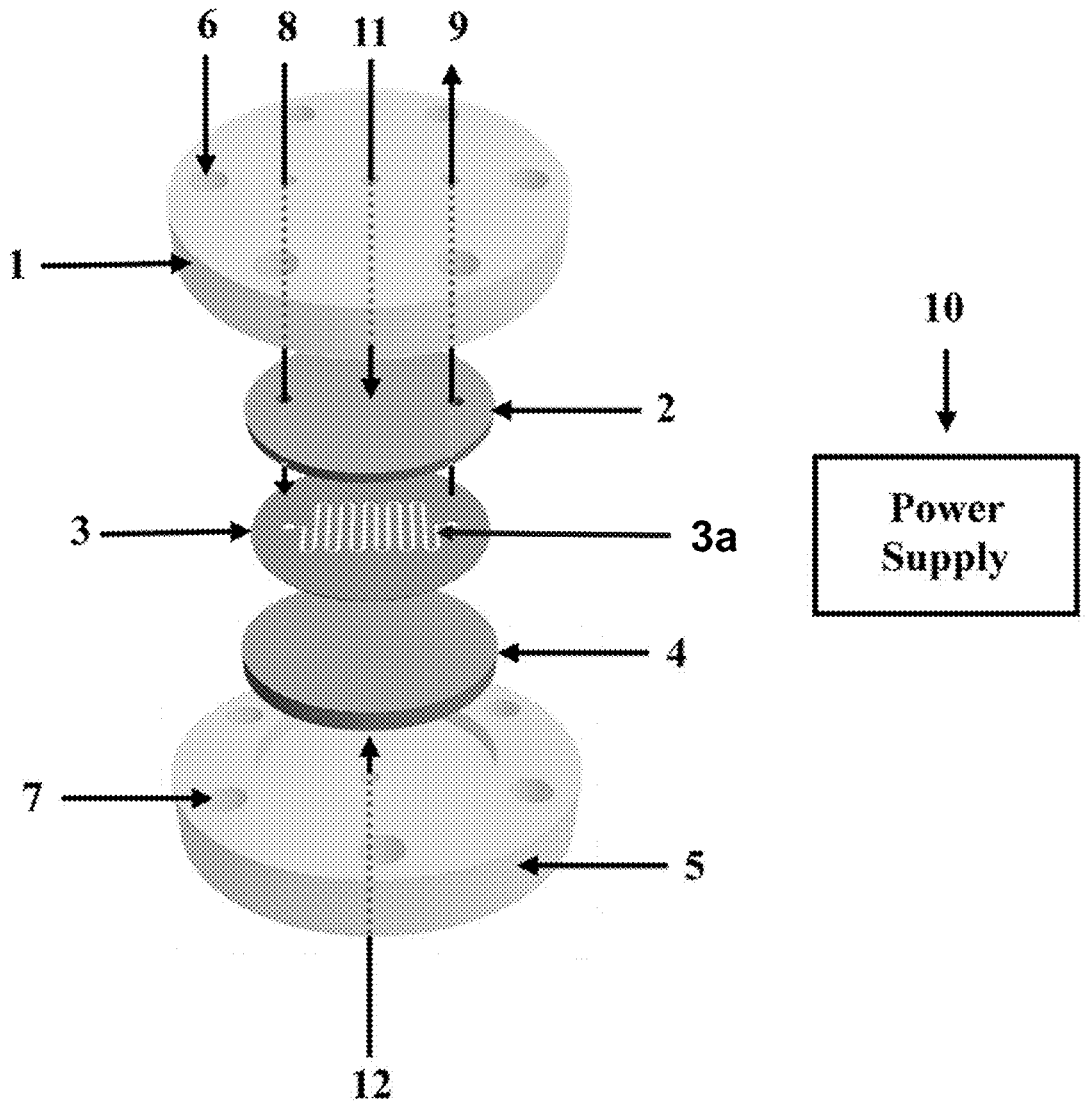

FIG. 2 presents a schematic representation of a particular embodiment of an undivided electrochemical cell that may be used in the implementation of the present invention.

Figure 3:
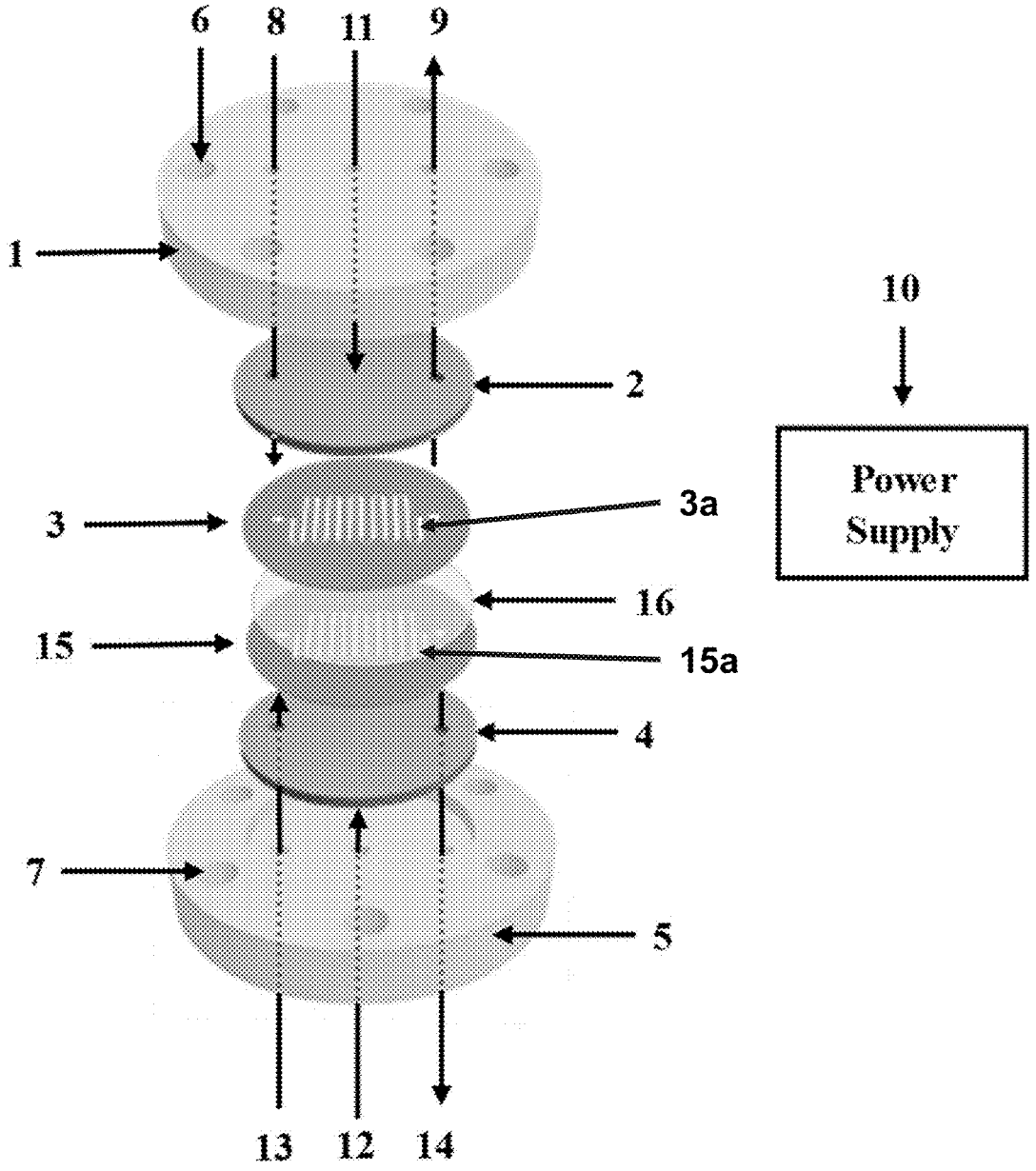

FIG. 3 presents a schematic representation of a particular embodiment of a divided electrochemical cell that may be used in the implementation of the present invention.

Figure 4:
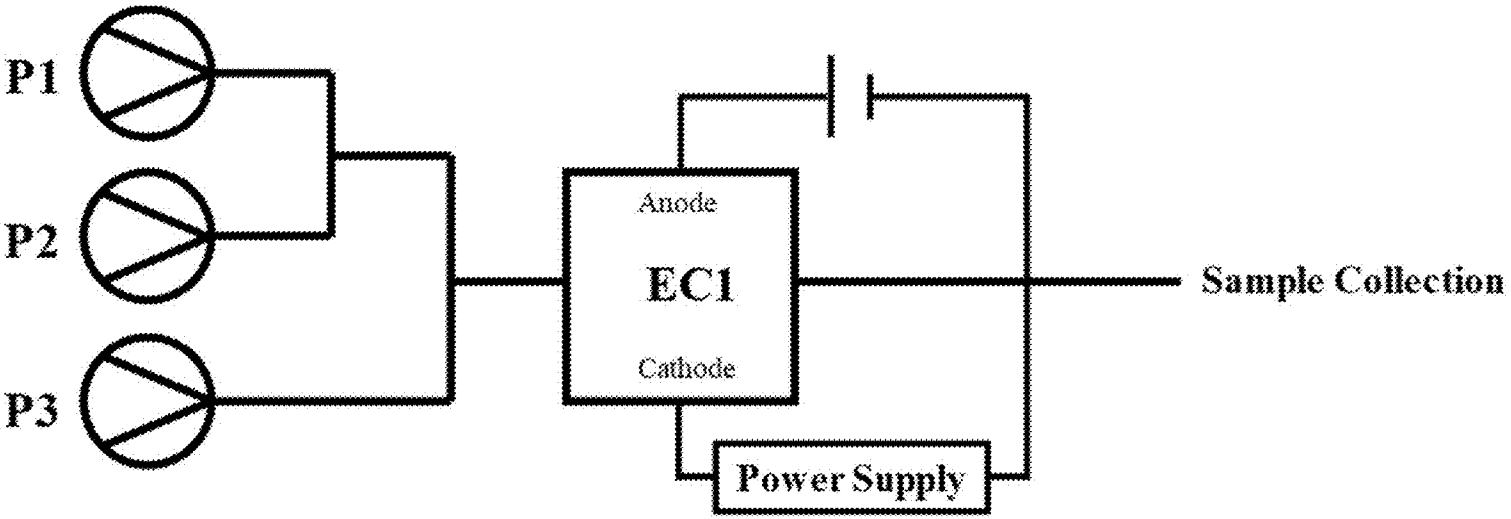

FIG. 4 presents a process flow diagram of a particular embodiment of the electrochemical oxidative addition of a halide or pseudohalide anion to a pseudohalide compound synthesized in an undivided electrochemical cell.

Figure 5:
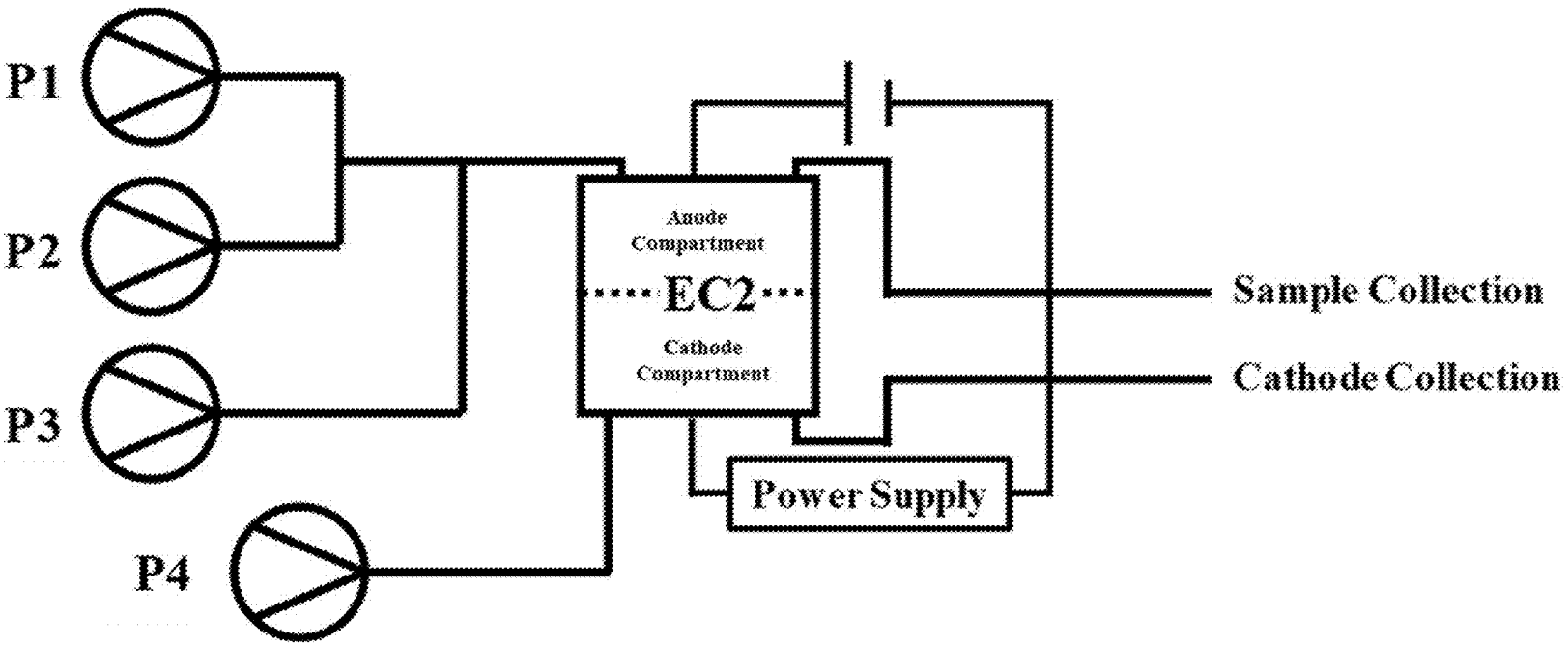

FIG. 5 presents a process flow diagram of a particular embodiment of the electrochemical oxidative addition of a halide or pseudohalide anion to a pseudohalide compound synthesized in a divided electrochemical cell.

Figure 6:
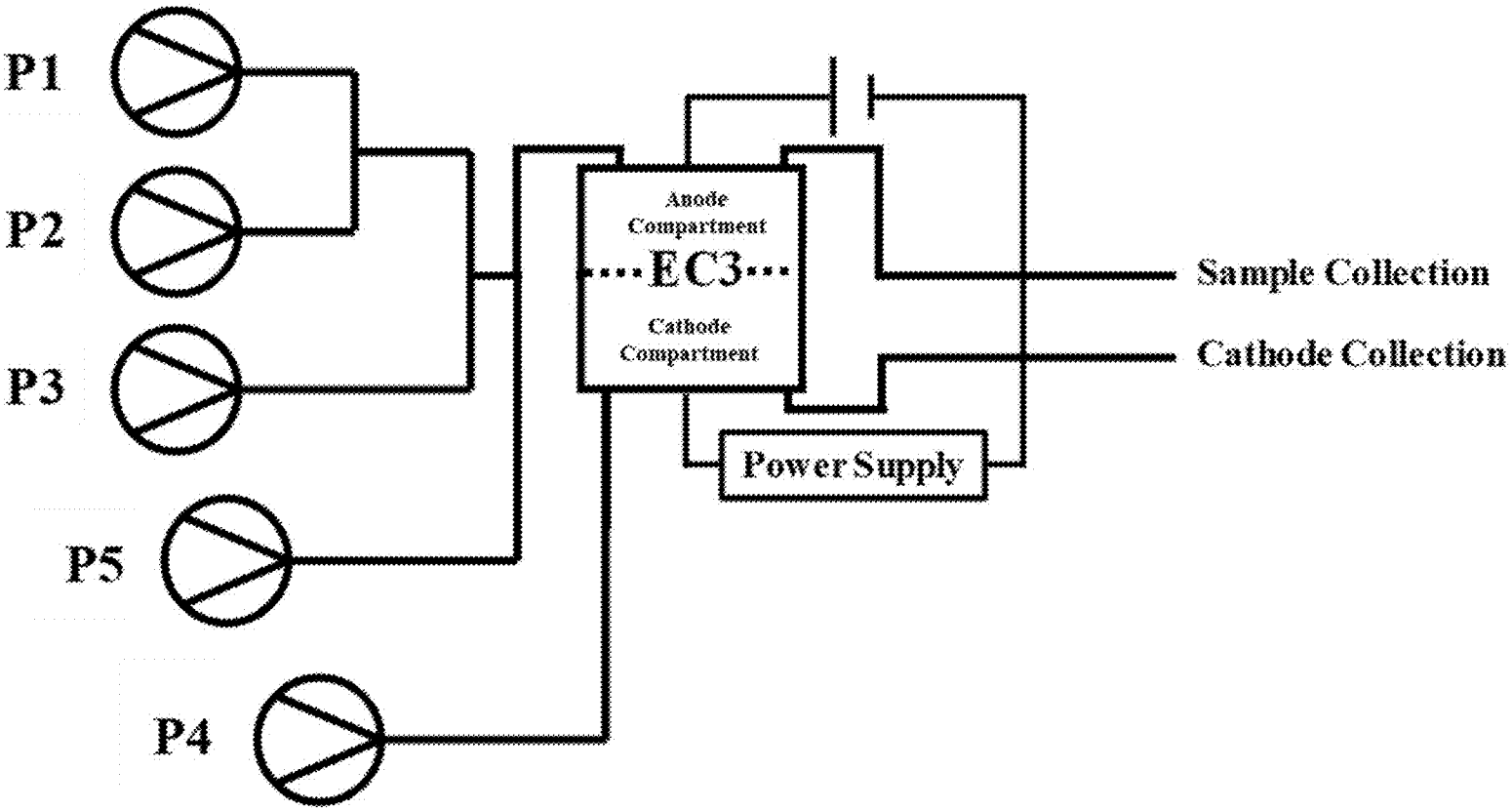

FIG. 6 presents a process flow diagram of a particular embodiment of the electrochemical oxidative addition of a halide or pseudohalide anion to a pseudohalide compound synthesized in a divided electrochemical cell.

It should be understood that the appended drawings are not necessarily to scale, presenting a somewhat simplified representation of various features illustrative of the basic principles of the invention. The specific design features of the sequence of operations as disclosed herein, including, for example, specific dimensions, orientations, locations, and shapes of various illustrated components, will be determined in part by the particular intended application and use environment. Certain features of the illustrated embodiments have been enlarged or distorted relative to others to facilitate visualization and clear understanding. In particular, thin features may be thickened, for example, for clarity or illustration.

DETAILED DESCRIPTION OF THE INVENTION

The present invention pertains to processes and methods for the microfluidic electrochemical synthesis of geminal dipseudohalide and halide-pseudohalide compounds from the corresponding pseudohalide compounds. The term geminal dipseudohalide and halide-pseudohalide compound used herein refers to a compound of Formula II in FIG. 1, which represents an organic compound having either two of the same or two different functional groups chemically bonded to the same carbon atom, respectively. The terms pseudohalide compound as used herein refers to an organic molecule with a nitro (—$NO_2$), cyano (—CN), cyanate (—CNO), thiocyanate (—SCN), thioisocyanate (—NCS), azido (—$N_3$) or similar pseudohalide functional group X bonded to a carbon atom with at least one acidic proton as depicted in Formula I in FIG. 1.

In recent years, microfluidics has garnered increasing attention for the synthesis and pilot scale production for a wide variety of compounds. Microfluidic-based reactions are operated in continuous flow and the chemical transformation occurs within micron-sized channels. The small channel size allows for excellent heat and mass transport owing to the large surface area to volume ratio of the microfluidic channels in comparison to batch reactors. As a result, microfluidic technologies are well suited for electrochemical synthesis. Owing to the small channel size and increased surface area to volume ratio, inter-electrode spacing may be minimized and the ohmic drop due to solution resistance is negligible, and the mass transport to the electrode surface is enhanced allowing for a single pass conversion of starting materials to products. Additionally, a microfluidic reaction may be scaled to production size, either by increasing the length of the channels while keeping the internal diameters of the channel constant or operating multiple micro-reactors simultaneously. As a result, microfluidic reactions may be scaled without the need for further optimization of reaction conditions at each scaling step.

The invention presents a process for the microfluidic electrochemical synthesis of a class of geminal dipseudohalide and halide-pseudohalide compounds in which the transformation is driven by the oxidation of a pseudohalide compound through direct electron transfer at the anode or with the help of a chemical mediator. This process provides marked improvement over the current state-of-the-art processes. By conducting the oxidative addition in a microfluidic device, the mass transport of the reagents at the electrode surface is improved, due to a higher electrode surface area to volume ratio, resulting in a shorter reaction time. As a result, the oxidative addition is more rapid than standard approaches and may be completed by passing the reagents through the electrochemical cell once. This allows for the operation of this process as a continuous flow device. Thus, this process may be scaled linearly to increase production rates without the concern of non-linear scaling problems associated with electrochemical batch processes. In addition, the absence of a poorly soluble co-oxidant allows the reaction to be conducted at significantly higher concentrations and results in a drastic decrease in the corresponding waste stream. In fact, the atom efficiency in the herein described microfluidic electrochemical system can approach 100%. Therefore, the presented process is significantly more economical and greener than other methods for the synthesis of geminal dipseudohalide and halide-pseudohalide compounds.

The described synthesis is conducted in a microfluidic electrochemical cell, which proceeds through the oxidative addition of a halide or pseudohalide anion to an organic pseudohalide compound to generate the geminal dipseudohalide or halide-pseudohalide species.

The following examples illustrate particular properties and advantages of some of the embodiments of the present invention. Furthermore, these are examples of reduction to practice of the present invention and confirmation that the principles described in the present invention are therefore valid but should not be construed as in any way limiting the scope of the invention.

Microfluidic electrochemistry, which is generally defined as electrochemical transformations occurring within a microfluidic reactor with a cross-sectional diameter less than 1 mm, has recently emerged as a rapidly advancing research field. Microfluidic flow technology has been well known for providing great control over reaction conditions, owing to their high surface-area-to-volume ratios and when applied to electrochemical transformations reactions these features improve reproducibility, increase production rate, and decrease energy requirements in comparison to a traditional batch-electrochemical process. In this work, processes and methods for the electrochemical synthesis of gem-dipseudohalide and gem-halide-pseudohalide compounds in a continuous flow microfluidic electrochemical cell were developed. This transformation is achieved through the selective oxidative addition of a halide or pseudohalide anion to an organic pseudohalide compound. Mechanistically, this is achieved through the direct oxidation of the organic pseudohalide and the corresponding intermediates at the surface of the anode, or by oxidation by a catalytic chemical mediator that is then regenerated at the surface of the anode. This generalized approach may be conducted within an undivided or a divided microfluidic electrochemical reactor. A description of this process and its generalized use in the synthesis of a variety of gem-dipseudohalide and gem-halide-pseudohalide compounds is presented and discussed.

FIG. 1 presents a schematic representation of the reaction for the conversion of a pseudohalide compound into a mixed geminal halide-pseudohalide, or geminal dipseudohalide compound, where $R_1$ and $R_2$ are used to represent any combination of H, methyl (—$CH_3$), ethyl (—$CH_2CH_3$), propyl (—$CH_2CH_2CH_3$), hydroxy (—OH), methoxy (—$CH_2OH$), ethoxy (—$CH_2CH_2OH$), methyl ester (—$CH_2COOCH_3$), propyl methyl ester (—$CH_2CH_2COOCH_3$), cyclopropyl, cyclobutyl, cyclopentyl, cyclohexyl, azetidine, oxetane, 2,2-dimethyl-1,3,dioxane, and phenyl functional groups. X represents a nitro (—$NO_2$), cyano (—CN), cyanate (—CNO), thiocyanate (—SCN), thioisocyanate (—NCS), or azido (—$N_3$) functional group and Y represents a nitro (—$NO_2$), cyano (—CN), cyanate (—CNO), thiocyanate (—SCN), thioisocyanate (—NCS), azido (—$N_3$), chloro (—Cl), or bromo (—Br) functional group.

Electrochemical cells used in the synthesis of compounds of Formula II (FIG. 1) have already been reported in prior art. Therefore, they will not be greatly expanded upon other than to supply a general depiction of the cell used for this conversion. This transformation has been demonstrated in both undivided (FIG. 2 and FIG. 4) and divided (FIG. 3, FIG. 5, and FIG. 6) microfluidic electrochemical cell setups.

FIG. 2 presents a schematic representation of a particular embodiment of an undivided (single compartment) electrochemical cell that may be used in the implementation of the present invention. An undivided (single compartment) cell is defined as a microfluidic electrochemical reactor in which the anode 2 and cathode 4 are simultaneously in contact with the same electrolyte solution, such that there are no physical restrictions of mass transport between the anode and cathode. The cell is composed of a spacer 3 having some void volume 3*a* in which solution can flow and that is sandwiched between the anode 2 and the cathode 4 which are connected to a power supply 10. In one embodiment, the spacer 3 may be constructed from a 0.396 mm PTFE sheet with a 1 mm wide serpentine channel 3*a* machined into the material. The electrodes 2 and 4 may be secured with two caps 1 and 5, constructed from any suitable material and mounted together with bolts or other devices through the openings 6 and 7. The reagents are introduced into the electrochemical micro-reactor through an inlet port 8 and exit the micro-reactor through an exit port 9. The undivided (single compartment) electrochemical reactor in FIG. 2 may be connected to a power supply 10 through the anode port 11 and the cathode port 12.

FIG. 3 presents a schematic representation of a particular embodiment of a divided (dual compartment) electrochemical cell that may be used in the implementation of the present invention. A divided (dual compartment) cell is defined as a microfluidic electrochemical reactor in which the anode 2 and the cathode 4 are separated by a semi-permeable membrane 16; thus, a physical barrier limits mass transport between the anode and cathode. The divided (dual compartment) electrochemical cell shares some features with the undivided (single compartment) electrochemical cell. Spacers for the anode (spacer 3) and cathode (spacer 15) compartments having some void volume 3*a* and 15*a* in which solution can flow are sandwiched between the electrodes 2 and 4 and a semi-permeable membrane 16. The spacers 3 and 15 may be constructed from a 0.396 mm PTFE sheet, in which a 1 mm wide serpentine channel was machined. The electrodes may be secured with two caps 1 and 5, constructed from any suitable material and mounted together with bolts or other devices through the plurality of openings 6 and 7 in each cap 1, 5. The reagents may be premixed and introduced into the anode compartment of the electrochemical cell through the anode inlet port 8 and exit the reactor through the anode exit port 9. The cathode solution should consist of a catholyte with an electrical conductivity of approximately 0.01 s/cm or greater, generally with a concentration greater than or equal to 0.1 M and may comprise of an alkali metal hydroxide or inorganic acid, such as a sulfuric or hydrochloric acid solution. The catholyte may be introduced into the cathode compartment through the cathode inlet port 13 and exits the reactor through the cathode outlet port 14. The divided (dual compartment) electrochemical reactor may be connected to a power supply 10 through the anode connection port 11 and the cathode connection port 12.

The electrochemical cell as depicted in FIG. 3 may be assembled with a variety of porous separators 16 such as diaphragms or semi-permeable membranes, including ion-exchange or ion-selective membranes. Membrane selection for this process is determined by the requirements for a specific reaction and the corresponding reaction conditions. The membrane material may consist of, but is not limited to, a proton exchange membrane (PEM), an anion exchange membrane (AEM), or a bipolar membrane. Preferably, a PEM or an AEM is used depending on the reaction conditions.

By way of a non-limiting example, either of the cells may be constructed with electrodes composed of or coated with a variety of materials which includes but is not limited to iron, nickel, platinum, copper, cobalt, titanium, gold, palladium, rhodium, iridium, ruthenium, silver, lead dioxide, or other mixed-metal oxides, graphite, carbon black, glassy carbon, or carbonaceous materials, or any combination thereof.

In the electrochemical cells described and illustrated in FIG. 2 (undivided, single compartment) and FIG. 3 (divided, dual compartment), the solutions delivered into the electrochemical cell may include a pseudohalide compound of Formula I, or a basic aqueous solution of a pseudohalide compound of Formula I, and an inorganic base, e.g. lithium, sodium, potassium, cesium, rubidium, or ammonium hydroxide. Various reagents may be delivered into the electrochemical reactor using syringe pumps, denoted P1-P5 in FIG. 3, FIG. 4, and FIG. 5 as described below.

An undivided (single compartment) microfluidic electrochemical cell is depicted in FIG. 4. Utilizing pumps P1, P2 and P3, a pseudohalide compound (Formula I), an aqueous base, and an aqueous mixture of a halide/pseudohalide salt (MY) and a mediator are delivered into the compartment of the electrochemical cell EC1. The cell is connected to a power supply to provide the electrical current or potential for the electrochemical transformation.

A divided (dual compartment) microfluidic electrochemical cell is depicted in FIG. 5. Utilizing pumps P1, P2 and P3, a pseudohalide compound (Formula I), an aqueous base, and an aqueous mixture of a halide/pseudohalide salt (MY) and a mediator are delivered into the anodic compartment of the electrochemical cell EC2. Utilizing pump P4, a solution of an inorganic base, such as a lithium, sodium, potassium, cesium, rubidium, or ammonium hydroxide, carbonate, or phosphate, an inorganic acid, such as sulfuric acid, hydrochloric acid, hydrobromic, or phosphoric acid, or an organic acid, such as formic acid, acetic acid, or propanoic acid, delivered into the cathode compartment of the electrochemical cell EC2. The anode and cathode compartment of the electrochemical cell are connected to a power supply to provide the electrical current or potential for the electrochemical transformation.

A divided cell (dual compartment) microfluidic electrochemical cell with in situ extraction is depicted in FIG. 6. Utilizing pumps P1, P2 and P3, a pseudohalide compound (Formula I), an aqueous base, and an aqueous mixture of a halide/pseudohalide salt (MY) and a mediator are delivered into the anodic compartment of the electrochemical cell EC3. In this particular embodiment of this invention, the product may be extracted within an organic solvent in situ to prevent degradation of the product within the electrochemical cell. This extraction may be accomplished with any organic solvent that is immiscible with water, such as, but not limited to chloroform, dichloromethane, 1,2-dichloroethane, carbon tetrachloride, cyclohexane, diethyl ether, dioxane, ethyl acetate, heptane, hexane, methyl ethyl ketone, methyl tert-butyl ether, pentane, toluene, xylene, or any other organic solvent that meets the above criteria. Preferably, either chloroform, dichloromethane, or ethyl acetate is used. The organic solvent may be introduced using pump P5, which results in a two-phase plug flow entering the anode compartment of the electrochemical cell EC3 (FIG. 6). The organic solvent will extract the geminal dipseudohalide or halide-pseudohalide product of the general Formula II and protect it from decomposition. The cathode solution may comprise an inorganic base, such as a lithium, sodium, potassium, cesium, rubidium, or ammonium hydroxide, carbonate, or phosphate, an inorganic acid, such as sulfuric acid, hydrochloric acid, hydrobromic, or phosphoric acid, or an organic acid, such as formic acid, acetic acid, or propanoic acid. The cathode solution is delivered into the cathode compartment utilizing pump P4.

The product of this process is an organic geminal dipseudohalide or a geminal halide-pseudohalide compound, which has the general formula $R_1R_2CXY$ (Formula II, FIG. 1). Depending on the target geminal dipseudohalide or halide-pseudohalide compound, a suitable pseudohalide starting material (Formula I, FIG. 1) may include but is not limited to pseudohaloalkanes, pseudohaloalkenes, pseudohaloalkyenes, pseudohaloaldehydes, pseudohaloketones, pseudohaloalcohols, pseudohalocarboxylic acids, pseudohalocyclic compounds, pseudohaloethers, pseudohalopolyesters, pseudohalopolymers, pseudohaloaromatics, pseudohaloamines, pseudohalocarbohydrates, pseudohaloheterocycles and combinations and isomers thereof. The concentration of the pseudohalide compound starting material within the electrochemical reactor may have a concentration of 0.1 M-5.0 M, preferably with a concentration of 1.0 M.

The pseudohalide compound may be delivered into the electrochemical reactor in the form of the neutral compound or as its conjugate base. Pseudohalide compounds suitable for this process have the general formula $R_1R_2CHX$ ($R_1$, $R_2$=H, methyl (—$CH_3$), ethyl (—$CH_2CH_3$), propyl (—$CH_2CH_2CH_3$), hydroxy (—OH), methoxy (—$CH_2OH$), ethoxy (—$CH_2CH_2OH$), methyl ester (—$CH_2COOCH_3$), propyl methyl ester (—$CH_2CH_2COOCH_3$), cyclopropyl, cyclobutyl, cyclopentyl, cyclohexyl, azetidine, oxetane, 2,2-dimethyl-1,3,dioxane, phenyl, or other organic functional group and X=nitro (—$NO_2$), azido (—$N_3$), cyano (—CN), cyanato (—OCN), -thiocyanato (SCN), isothiocyanato (—NCS) or other pseudohalide moieties. Examples of suitable compounds for this invention include, but are not limited to, nitromethane, 1-nitroethane, 1-nitropropane, 1-nitrobutane, 2-nitropropane, 2-nitrobutane, 2-nitroethanol, 1-nitropropanol, 2-nitropropanol, 1-nitrobutanol, 2-nitrobutanol, 1-t-butyl-3-hydroxymethyl-3-nitroazetidine, 2-nitropropyl methyl ether, 3-nitrooxetane, 2-nitro-1,3-diethoxypropane, 1-nitrocyclohexane, 1-nitrocyclopentane, 2, 2-dimethyl-5-nitro-1, 3-dioxane, nitrocyclohexane, 2-nitro hexane, 5-nonyl nitrate, 2-pentyl nitrate, 2-methoxyethyl nitrate, 1-methyl-2-methoxyethyl nitrate, 3-nitropropionic acid, 2-nitropropionate, phenylnitromethane, nitro-cycloalkyl, nitro alkyl, nitro-aryl, nitro-alkaryl, nitroaralkyl, nitro-alkoxy, nitro-alkyl ethers, nitro-alkyl esters, and nitro-carboxylic acid esters. The concentration of the pseudohalide compound delivered into the electrochemical cell was generally between 0.1-2.5 M, preferably with a concentration of 1.0 M.

The aqueous base may be delivered into the electrochemical reactor in the form of water-soluble hydroxides, carbonates, or phosphates. The base within this reaction may deprotonate the pseudohalide starting material of Formula I in FIG. 1. Inorganic bases suitable for this process include, but are not limited to, alkali metal or ammonium hydroxides, alkali metal carbonates, or phosphates, such as lithium hydroxide (LiOH), sodium hydroxide (NaOH), potassium hydroxide (KOH), cesium hydroxide (CsOH), rubidium hydroxide (RbOH), ammonium hydroxide ($NH_4OH$), lithium carbonate ($Li_2CO_3$), sodium carbonate ($Na_2CO_3$), potassium carbonate ($K_2CO_3$), cesium carbonate ($Cs_2CO_3$), rubidium carbonate ($Rb_2CO_3$), lithium phosphate ($Li_2PO_4$), sodium phosphate ($Na_3PO_4$), sodium phosphate dibasic ($Na_2HPO_4$), potassium phosphate ($K_3PO_4$), potassium phosphate dibasic ($K_2HPO_4$), or ammonium phosphate dibasic ($(NH_4)_2PO_4$). Preferably, the base used in the oxidation includes sodium or potassium hydroxide. Throughout the electrochemical reaction, the concentration of the base is high enough to maintain a pH of 8-14, preferably 12. The molar ratio between the pseudohalide compound (Formula I) and the base is generally between 1:1 and 1:10, preferably with a molar ratio of 2:3.

For the synthesis of a geminal dipseudohalide and halide-pseudohalide compound of Formula II, the halide or pseudohalide salt MY may be delivered into the electrochemical system in form of an alkali metal or ammonium salt. Pseudohalide salt sources suitable for this process include, but are not limited to, lithium, sodium, potassium, cesium, rubidium, and ammonium salts of nitrite ($NO_2^-$), cyanide ($CN^-$), cyanate ($CNO^-$), thiocyanate ($SCN^-$), thioisocyanate ($NCS^-$), azide ($N_3^-$) anions. Several examples of these include sodium nitrite ($NaNO_2$), potassium nitrite ($KNO_2$), sodium cyanide (NaCN), potassium cyanide (KCN), sodium cyanate (NaCNO), potassium cyanate (KCNO), sodium thiocyanate (NaSCN), potassium thiocyanate (KSCN), sodium thioisocyanate (NaNCS), potassium thioisocyanate (KNCS), sodium azide ($NaN_3$), or potassium azide ($KN_3$). Halide salt sources suitable for this process includes, but are not limited to, lithium chloride (LiCl), potassium chloride (KCl), sodium chloride (NaCl), cesium chloride (CsCl), rubidium chloride (RbCl), ammonium chloride ($NH_4Cl$), lithium bromide (LiBr), potassium bromide (KBr), sodium bromide (NaBr), cesium bromide (CsBr), rubidium bromide (RbBr), or ammonium bromide and ($NH_4Br$). The molar ratio of the pseudohalide compound of Formula I to the halide or pseudohalide salt (MY) within the electrochemical reactor can be from 1:1 to 1:20, preferably the ratio is 2:3.

The mediator may be introduced into the electrochemical cell in the form of organic compounds or transition metal complexes. The mediator may be introduced into the electrochemical reactor as the active or inactive form of the catalyst, such that the inactive form will be oxidized to the active form by the electrode within the microfluidic electrochemical cell. Electrochemical mediators suitable for the process encompasses but are not limited to potassium ferricyanide $K_3Fe(CN)_6$, potassium ferrocyanide ($K_4Fe(CN)_6$), benzoquinone, 2,2-Azino-bis(2-ethylbenzothiazoline-6-sulfonic acid), 1,1-Dimethyl-ferrocene, ferrocene monocarboxylic acid, sodium ferricyanide, 2,6-dichlorophenol-indophenol, hexaammineruthenium (III) chloride, 1,4-Napthoquinone, or $Os(im(dm\text{-}bpy)_2Cl$. The specific mediator used in the oxidative addition does not limit the scope of this invention. The molar ratio of the mediator with respect to the pseudohalide compound of Formula I is typically between 1:0.01 to 1:0.5; preferably, the ratio is 1:0.1.

The composition of the cathode solution delivered into the cathode compartment of the electrochemical cell may be comprised of an aqueous alkali metal base, mineral acid, or organic acid. Examples of suitable alkali metal bases include hydroxide, carbonate, bicarbonate, and phosphates. This includes lithium hydroxide (LiOH), sodium hydroxide (NaOH), potassium hydroxide (KOH), cesium hydroxide (CsOH), rubidium hydroxide (RbOH), ammonium hydroxide ($NH_4OH$), lithium carbonate ($Li_2CO_3$), sodium carbonate ($Na_2CO_3$), potassium carbonate ($K_2CO_3$), cesium carbonate ($Cs_2CO_3$), rubidium carbonate ($Rb_2CO_3$), lithium phosphate ($Li_2PO_4$), sodium phosphate ($Na_3PO_4$), sodium phosphate dibasic ($Na_2HPO_4$), potassium phosphate ($K_3PO_4$), potassium phosphate dibasic ($K_2HPO_4$), or ammonium phosphate dibasic ($(NH_4)_2PO_4$). Examples of mineral acids include hydrochloric acid (HCl), hydrobromic acid (HBr), phosphoric acid ($H_3PO_4$), sulfuric acid ($H_2SO_4$), and nitric acid ($HNO_3$). Examples of suitable organic acids include but are not limited to formic acid, acetic acid, and propionic acid. Typical concentration of the acid or base catholytes range from 0.1 M to 10 M, preferably about 2 M.

In a particular embodiment, the geminal dipseudohalide compound, 1,1-dinitroethane, was synthesized in an undivided electrochemical cell similar to the cell illustrated in FIG. 2 using the electrochemical set-up depicted in FIG. 4. In this embodiment, 1-nitroethane (Formula I) is delivered into the system utilizing pump P1 and combined with a 3.0 M solution of sodium hydroxide, which is delivered by pump P2. The concentration ratio of 1-nitroethane to sodium hydroxide was generally 1:1.5. This mixed solution is combined with an aqueous solution containing sodium nitrite (MY) and the potassium ferrocyanide mediator, with an initial concentration of 5.0 M and 0.25 M, respectively. The aqueous mixture of sodium nitrite and potassium ferrocyanide is delivered through pump P3 before it enters the undivided (single compartment) microfluidic electrochemical cell. The molar ratio of sodium nitrite and potassium ferrocyanide to 1-nitroethane were 4:1 and 0.2:1, respectively. The flow rates of the reagents were adjusted to achieve a residence time of about 10 min in the electrochemical cell at a current density of 1.0 $A/dm^2$. Upon leaving the reactor, the reaction solution was quenched with phosphoric acid, followed by extraction with chloroform in flow. The aqueous-organic mixture was separated employing a continuous separator. The chloroform solution was collected, dried over $MgSO_4$, filtered, concentrated in vacuo and analyzed by $^1H$-NMR spectroscopy.

In another embodiment, the geminal dipseudohalide product of Formula II, 1,1-dinitroethane, may be synthesized in a divided (dual compartment) electrochemical cell, similar to that depicted and represented in FIG. 3, using a microfluidic set-up depicted in FIG. 5. The anode and cathode compartments in this embodiment were separated by a Nafion® NR-211 proton exchange membrane. Reagents were delivered into the anode compartment in the following manner. 1-Nitroethane is delivered utilizing pump P1 and combined with 3.0 M sodium hydroxide, delivered by pump P2, to generate a homogeneous solution which may require an in-line mixer. The concentration ratio of 1-nitroethane to sodium hydroxide was generally 1:1.5. This mixed solution is combined with an aqueous sodium nitrite (MY) solution containing the mediator potassium ferrocyanide, with an initial concentration of 5.0 M and 0.25 M, respectively. The sodium nitrite and potassium ferrocyanide are delivered through pump P3 before it enters the undivided (single compartment) microfluidic electrochemical cell. The molar ratio of sodium nitrite and potassium ferrocyanide to 1-nitroethane were 4:1 and 0.2:1, respectively. The cathode compartment included a 2.0 M sodium hydroxide solution that was delivered to the cathode compartment via pump P4. The flow rates of the reagents were adjusted to achieve a residence time of about 10 min in the electrochemical cell at a current density of 0.7 $A/dm^2$. The anode solution eluting from the reactor was processed in the same way as in the previous example and analyzed via $^1H$-NMR.

In another embodiment, the geminal halide-pseudohalide product of Formula II, 1-chloro-1-nitroethane, may be synthesized in a divided electrochemical reactor, similar to that depicted in FIG. 3 in a microfluidic set-up similar to the one depicted in FIG. 6. The anode and cathode compartments in this embodiment were separated by a Nafion® NR-211 proton exchange membrane. In this example, the 1-nitroethane (Formula I) was delivered by pump P1 and combined with a 3.0 M sodium hydroxide solution delivered by pump P2. This solution was then mixed with a solution delivered by P3 comprising an aqueous solution of sodium chloride (MY), with an initial concentration of 5.0 M, and 0.1 M potassium ferrocyanide mediator. The molar ratio of sodium chloride to 1-nitroethane was 10:1. An extraction solvent was necessary to prevent the decomposition of 1-chloro-1-nitroethane once it formed, so chloroform was introduced via pump P5 in-flow to create a two-phase plug flow system entering the anode compartment. The cathode compartment consisted of a 0.2 M solution of sulfuric acid flowing at the same flow rate as the combined anode solutions. The reagents were retained in the reactor for 1.5 min with a current density of 5.0 A/dm$^2$. The aqueous-organic mixture was separated employing a continuous separator. The chloroform solution was collected, dried over $MgSO_4$, filtered, concentrated in vacuo and analyzed with $^1$H-NMR spectroscopy.

EXAMPLES

The electrode materials were acquired from American Elements (Los Angeles, CA). All electrodes had diameters of 59.5 mm. The electrochemical spacers were designed in-house from PTFE with thicknesses between 0.4 mm and 1.59 mm. The electrochemical cell used for these transformations contained spacers (spacer 3 in FIG. 2 and spacers 3 and 15 in FIG. 3) of various thicknesses. When operating the setup as a divided cell (shown in FIG. 3), the cathode spacer 3 was generally slightly thicker to allow for faster flow rates. This improves the efficiency of the electrochemical cells but is not necessary for the transformation to occur. The volume of the undivided electrochemical reactor measured 0.15 mL. In case of the divided microfluidic cell, the anode compartment had a volume of 0.15 mL and the cathode compartment measured 0.30 mL in volume.

The reagents were filled into Norm-Ject syringes and injected into the electrochemical cell with Chemyx Fusion 200 syringe pumps. 1/16" diameter FEP tubing, acquired from IDEX, was solely used in the microfluidic set-up.

The electrolysis was performed under both potentiostatic and galvanostatic conditions. Prior to the reaction, the microfluidic electrolytic cell was primed with the reagent solutions at their predetermined flow rates for 30 min. While priming the reactor, the current and potential in the electrolytic cell stabilized and reached steady-state condition. After the priming of the reactor, the solution eluting from the cell containing the geminal pseudohalide or halide pseudohalide compound was treated with 1 M phosphoric acid to adjust the pH to 4-5 and then extracted with chloroform or ethyl acetate. The organic extract was analyzed by GC/MS, GC/FID, and $^1$H-NMR spectroscopy.

Example 1. Electrochemical Synthesis of 1,1-Dinitropropane through Electrolysis of 1-Nitropropane in an Undivided (Single Compartment) Electrochemical Cell (FIG. 2) Utilizing the Microfluidic Set-up Depicted in FIG. 4

Reagent solutions were injected into a 150 μL undivided electrolysis cell, as described in FIG. 2 employing the microfluidic set-up depicted in FIG. 4. The undivided electrolysis cell was equipped with an iron anode and carbon cathode and syringe pumps P1, P2 and P3, to inject the reagents. The neat pseudohalide starting material of Formula I, 1-nitropropane, was combined with an aqueous sodium hydroxide solution prior to the addition of an aqueous solution of $NaNO_2$ (MY) containing the mediator potassium ferrocyanide. The final concentrations of 1-nitropropane, sodium hydroxide, sodium nitrite, and potassium ferrocyanide were 1 M, 1.5 M, 4.0 M, and 0.2 M, respectively. The electrolysis cell was primed for 30 min at a flow rate of 10 μL/min and at a current density of 1.0 A/dm$^2$, corresponding to a potential of 1.5-2.5 V. The solution eluting from the reactor was neutralized with 1 M phosphoric acid and extracted with chloroform three times. The chloroform extract was dried over $MgSO_4$ and concentrated in vacuo. The material was dissolved in deuterated chloroform and analyzed via $^1$H-NMR spectroscopy. The yield of 1,1-dinitropropane was 28% with a conversion of 41%. $^1$H-NMR (400 MHz, $CDCl_3$) $CH_3C(NO_2)_2CH_3$ δ 1.0; (t, 3H, s), 2.22; (m, 2H, br), 6.13; (t, 1H, s).

Example 2. Mediated Electrochemical Synthesis of 1,1-Dinitroethane through Electrolysis of 1-Nitroethane in a Divided (Dual Compartment) Electrochemical Cell The anode and cathode compartment were divided by a 25 μm Nafion® N-211 membrane, with an anode compartment of 150 μL and a cathode compartment of 250 μL in volume. The anode compartment was equipped with an iron electrode and the cathode compartment with a carbon electrode. Each reagent solution was prepared separately and injected into the reactor using syringe pumps. The neat pseudohalide starting material of Formula I, 1-nitroethane, was combined with an aqueous solution of sodium hydroxide in flow. This solution was then combined with an aqueous solution containing the chemical mediator, $K_4Fe(CN)_6$ and sodium nitrite (MY). Once the reagents were combined, they were introduced into the anode compartment of the electrochemical micro-reactor. The concentrations of 1-nitroethane, sodium hydroxide, sodium nitrite, and potassium ferrocyanide in the final mixture were 1 M, 1.5 M, 4.0 M, and 0.2 M, respectively. A solution of 2.0 M NaOH was pumped directly into the cathode compartment. Both the anode and cathode compartments were primed for 30 min at a flow rate of 10 μL/min and at a current density of 0.7 A/dm$^2$, corresponding to a potential of 1.8-2.2 V. The product eluting from the anode compartments was neutralized with a 1 M aqueous solution of $H_3PO_4$ and extracted with chloroform three times. The chloroform extract was dried over $MgSO_4$ and concentrated in vacuo. The material was dissolved in deuterated chloroform and analyzed via NMR spectroscopy. The yield of 1,1-dinitroethane was 92% with a conversion of 100%. $^1$H-NMR (400 MHz, $CDCl_3$) $CH_3CH(NO_2)_2$ δ 1.78; (d, 3H, s), 6.2; (q, 1H, br).

Example 3. Electrochemical Synthesis of 1-Chloro-1-Nitroethane through Electrolysis of 1-Nitroethane in a Divided (Dual Compartment) Electrochemical Cell The electrochemical cell was assembled in the same manner as the cell described in Example 2 and employed a divided cell as depicted in FIG. 3, and the flow arrangement presented in FIG. 6. The neat pseudohalide starting material of Formula I, 1-nitroethane was combined with an aqueous solution of sodium hydroxide in flow. The solution was then mixed with an aqueous solution containing the chemical mediator $K_4Fe(CN)_6$ and sodium chloride (MY). The molar ratio between nitroethane, potassium ferricyanide, and sodium chloride were 1:0.1:10. Plug flow was then established with chloroform injected via pump P5 to extract the geminal halide-pseudohalide product of Formula II, 1-chloro-1-nitroethane, as it was being formed to prevent degradation. The volume flow rate between the aqueous and chloroform phases were 1:1. Once plug flow was established, the reagents entered the anode compartment of the electrochemical cell. The residence time was 1.5 min, and the current density was 5 $A/dm^2$. The cathode solution was comprised of a dilute solution of sulfuric acid, which had a concentration of 0.2 M. Upon the anode solution exiting the reactor, it was separated using an in-flow continuous separation module, and the organic layer was dried over $MgSO_4$ and concentrated in vacuo. The material was dissolved in deuterated chloroform and analyzed via NMR spectroscopy. The yield of 1-chloro-1-nitroethane was 67% with a conversion of 79%. $^1$H-NMR (400 MHz, $CDCl_3$) $CH_3CHNO_2C_1$ δ 2.05; (d, 3H, s), 5.94; (q, 1H, br).

Example 4. Electrochemical Synthesis of 1-Bromo-1-Nitroethane through Electrolysis of 1-Nitroethane in a Divided (Dual Compartment) Electrochemical Cell The same experiment setup and conditions were used as in Example 3, except NaBr (MY) was used as the halide salt source. The yield of 1-bromo-1-nitroethane was 53% with a conversion of 87%. (400 MHz, $CDCl_3$) $CH_3CHNO_2Br$ δ 2.18; (d, 3H, s), 6.05; (q, 1H, br).

Example 5. Electrochemical Synthesis of 1-Azido-1-Nitroethane through Electrolysis of 1-Nitroethane in a Divided (Dual Compartment) Electrochemical Cell The same experiment setup and conditions were used as in Examples 3 and 4, except $NaN_3$ (MY) was used as the pseudohalide salt reagent. The yield and conversion of this process was not determined. (400 MHz, $CDCl_3$) $CH_3CHNO_2N_3$ δ 1.80; (d, 3H, s), 5.35; (q, 1H, br).

While the present invention has been illustrated by a description of one or more embodiments thereof and while these embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the scope of the general inventive concept.

What is claimed is:

1. A process for the microfluidic electrochemical synthesis of geminal dipseudohalide or halide-pseudohalide compounds comprising the steps of:

pumping a solution comprising a compound of Formula I

I

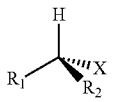

wherein for Formula I, $R_1$ and $R_2$ are any combination of H, methyl (—$CH_3$), ethyl (—$CH_2CH_3$), propyl (—$CH_2CH_2CH_3$), hydroxy (—OH), methoxy (—$CH_2OH$), ethoxy (—$CH_2CH_2OH$), methyl ester (—$CH_2COOCH_3$), propyl methyl ester (—$CH_2CH_2COOCH_3$), cyclopropyl, cyclobutyl, cyclopentyl, cyclohexyl, azetidine, oxetane, 2,2-dimethyl-1,3,dioxane, and phenyl, and X is a pseudohalide moiety selected from the group consisting of nitro (—$NO_2$), cyano (—CN), cyanate (—CNO), thiocyanoate (—SCN), and thioisocyanato (—NCS)

through a continuous flow microfluidic electrochemical reactor in the presence of a base, one of a halide salt or pseudohalide salt (MY), and a mediator;

applying an electrical current through the continuous flow microfluidic electrochemical reactor; and performing a single pass oxidative addition to create a geminal dipseudohalide or halide-pseudohalide compound of the general Formula II

II

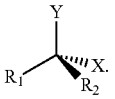

wherein for Formula II, $R_1$ and $R_2$ are any combination of H, methyl (—$CH_3$), ethyl (—$CH_2CH_3$), propyl (—$CH_2CH_2CH_3$), hydroxy (—OH), methoxy (—$CH_2OH$), ethoxy (—$CH_2CH_2OH$), methyl ester (—$CH_2COOCH_3$), propyl methyl ester (—$CH_2CH_2COOCH_3$), cyclopropyl, cyclobutyl, cyclopentyl, cyclohexyl, azetidine, oxetane, 2,2-dimethyl-1,3,dioxane, and phenyl, and X is a pseudohalide moiety selected from the group consisting of nitro (—$NO_2$), cyano (—CN), cyanate (—CNO), thiocyanoate (—SCN), and thioisocyanato (—NCS) and Y is a nitro (—NO), cyano (—CN), cyanate (—CNO), thiocyanate (—SCN), thioisocyanate (—NCS), azido (—$N_3$), chloro (—Cl), or bromo (—Br) functional group.

2. The process of claim 1, wherein the compound of Formula I has the structure of $R_1R_2CHX$ and $R_1$ and $R_2$ are any combination of H, methyl (—$CH_3$), ethyl (—$CH_2CH_3$), propyl (—$CH_2CH_2CH_3$), hydroxy (—OH), methoxy (—$CH_2OH$), ethoxy (—$CH_2CH_2OH$), methyl ester (—$CH_2COOCH_3$), propyl methyl ester (—$CH_2CH_2COOCH_3$), cyclopropyl, cyclobutyl, cyclopentyl, cyclohexyl, azetidine, oxetane, 2,2-dimethyl-1,3,dioxane, and phenyl, and X is a pseudohalide moiety selected from the group consisting of nitro (—$NO_2$), cyano (—CN), cyanate (—CNO), thiocyanoate (—SCN), and thioisocyanato (—NCS).

3. The process of claim 1, wherein the base comprises at least one hydroxide, carbonate, or phosphate and a cation selected from the group consisting of [Li]+, [Na]+, [K]+, [Cs]+, [Rb]+, and [$NH_4$]+.

4. The process of claim 1, wherein the base comprises at least one of lithium hydroxide (LiOH), sodium hydroxide (NaOH), potassium hydroxide (KOH), cesium hydroxide (CsOH), rubidium hydroxide (RbOH), ammonium hydroxide ($NH_4OH$), lithium carbonate ($Li_2CO_3$), sodium carbonate ($Na_2CO_3$), potassium carbonate ($K_2CO_3$), cesium carbonate ($Cs_2CO_3$), rubidium carbonate ($Rb_2CO_3$), lithium phosphate ($Li_2PO_4$), sodium phosphate ($Na_3PO_4$), sodium phosphate dibasic ($Na_2HPO_4$), potassium phosphate ($K_3PO_4$), potassium phosphate dibasic ($K_2HPO_4$), or ammonium phosphate dibasic ($(NH_4)_2PO_4$).

5. The process of claim 1, wherein the pseudohalide salt (MY) is selected from the group consisting of [Li]+, [Na]+, [K]+, [Cs]+, [Rb]+, and $[NH_4]$+ salts of nitrite ($NO_2^-$), azide ($N_3^-$), cyanide ($CN^-$), cyanate ($OCN^-$), thiocyanate ($SCN^-$), and isothiocyanate ($NCS^-$).

6. The process of claim 1, wherein the pseudohalide salt (MY) is selected from the group consisting of sodium nitrite ($NaNO_2$), potassium nitrite ($KNO_2$), sodium cyanide (NaCN), potassium cyanide (KCN), sodium cyanate (NaCNO), potassium cyanate (KCNO), sodium thiocyanate (NaSCN), potassium thiocyanate (KSCN), sodium thioisocyanate (NaNCS), potassium thioisocyanate (KNCS), sodium azide ($NaN_3$), and potassium azide ($KN_3$).

7. The process of claim 1, wherein a halide salt (MY) source is selected from the group consisting of [Li]+, [Na]+, [K]+, [Cs]+, [Rb]+ and $[NH_4]$+ salts of chloride ($Cl^-$) and bromide ($Br^-$).

8. The process of claim 1, wherein the halide salt (MY) is selected from the group consisting of lithium chloride (LiCl), potassium chloride (KCl), sodium chloride (NaCl), cesium chloride (CsCl), rubidium chloride (RbCl), ammonium chloride ($NH_4Cl$), lithium bromide (LiBr), potassium bromide (KBr), sodium bromide (NaBr), cesium bromide (CsBr), rubidium bromide (RbBr), and ammonium bromide ($NH_4Br$).

9. The process of claim 1, wherein the mediator is selected from the group consisting of potassium ferricyanide ($K_3Fe(CN)_6$), potassium ferrocyanide ($K_4Fe(CN)_6$), benzoquinone, 2,2-azino-bis(2-ethylbenzothiazoline-6-sulfonic acid), 1,1-dimethyl-ferrocene, ferrocene monocarboxylic acid, sodium ferricyanide, 2,6-dichlorophenol-indophenol, hexaammineruthenium (III) chloride, 1,4-napthoquinone, and $Os(im)(dm\text{-}bpy)_2Cl$.

10. The process of claim 1, further comprising controlling the oxidative addition of said halide salt or said pseudohalide salt (MY) to the compound of Formula I through one of potentiostatic (controlled potential) or galvanostatic (controlled current) operating conditions.

11. The process of claim 1, wherein the microfluidic electrochemical reactor comprises electrodes comprising an element selected from the group consisting of iron, nickel, platinum, copper, cobalt, titanium, lead dioxide, mixed metal oxides, gold, palladium, rhodium, iridium, ruthenium, silver, graphite, carbon black, glassy carbon, carbonaceous materials and mixtures thereof.

12. The process of claim 11, wherein the microfluidic electrochemical reactor is an undivided (single compartment) microfluidic electrochemical cell.

13. The process of claim 1, wherein an oxidative addition reaction is conducted in an anode compartment in a two-phase plug-flow, the two-phase plug flow comprising said solution and an organic solvent, to continually extract the compound of Formula II.

14. The process of claim 13, wherein the organic solvent is immiscible with water, and is selected from the group consisting of chloroform, dichloromethane, 1,2-dichloroethane, carbon tetrachloride, cyclohexane, diethyl ether, dioxane, ethyl acetate, heptane, hexane, methyl ethyl ketone, methyl tert-butyl ether, pentane, toluene, and xylene.

* * * * *